US008478153B2

(12) United States Patent
Barton et al.

(10) Patent No.: US 8,478,153 B2
(45) Date of Patent: Jul. 2, 2013

(54) METHODS, APPARATUS, AND SYSTEMS FOR FUSER ASSEMBLY POWER CONTROL

(75) Inventors: Augusto E. Barton, Webster, NY (US); Jeffrey Nyyssonen Swing, Rochester, NY (US); Faming Li, Penfield, NY (US); Daniel J. McVeigh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 293 days.

(21) Appl. No.: 12/948,201

(22) Filed: Nov. 17, 2010

(65) Prior Publication Data

US 2012/0123608 A1 May 17, 2012

(51) Int. Cl.
*G03G 15/20* (2006.01)
*G03G 15/00* (2006.01)

(52) U.S. Cl.
USPC ..... 399/67; 399/69; 399/88

(58) Field of Classification Search
USPC ..... 399/67, 69, 88, 328, 329, 330
See application file for complete search history.

(56) References Cited

U.S. PATENT DOCUMENTS

| | | | | |
|---|---|---|---|---|
| 6,490,423 | B2 * | 12/2002 | Horobin et al. | 399/67 |
| 7,054,572 | B2 | 5/2006 | Baruch et al. | |
| 7,327,964 | B2 * | 2/2008 | Funabiki et al. | 399/67 X |
| 2008/0008488 | A1 * | 1/2008 | Kaji et al. | 399/67 |
| 2009/0074442 | A1 * | 3/2009 | Sano et al. | 399/69 |
| 2009/0238595 | A1 * | 9/2009 | Okada | 399/69 |

* cited by examiner

*Primary Examiner* — Sandra Brase
(74) *Attorney, Agent, or Firm* — Ronald E. Prass, Jr.; Prass LLP

(57) ABSTRACT

A fuser assembly stepped power control system includes a controller that outputs control signals to independently control individual lamps in the fuser assembly. Multiple lamps are turned on with a delay between actuation of each lamp to reduce in-rush current. Control signals are output by the controller as a function of temperature error.

17 Claims, 8 Drawing Sheets

METHODS, APPARATUS, AND SYSTEMS FOR FUSER ASSEMBLY POWER CONTROL

FIELD OF DISCLOSURE

The disclosure relates to methods, apparatus, and systems for controlling fuser heating member power. The disclosure further relates to controlling fuser lamp power to minimize peak in-rush current and accommodate fuser assembly temperature control.

BACKGROUND

Related art fuser assembly temperature control is typically carried out by traditional ON/OFF lamp control based on setpoints and deadbands. ON/OFF cycles of lamps may be controlled by restricting an amount of power delivered to the assembly at particular times. Better temperature control may be achieved at the expense of more frequent lamp ON/OFF cycles. Related art methods of controlling the amount of power delivered to a fuser assembly include PWM AC chopper, cycle stealing, and phase control.

SUMMARY

Related art power control methods and systems typically do not efficiently accommodate satisfactory flicker and harmonics. For example, cycle stealing accommodates low harmonics, but suffers from high peak in-rush current, which may lead to flicker. Phase angle control may accommodate low flicker, but it is costly and may not satisfy harmonics requirements. PWM AC chopper methods may address flicker and harmonic requirements, but such methods require additional components and can be costly.

Methods, apparatus, and systems disclosed herein reduce the peak in-rush current, and accommodate reduced temperature fluctuation while minimizing additional costs. Cost reduction may be achieved by controlling an average amount of power directed to a fuser by, for example, dynamically changing fuser lamp turn ON time delay. The lamp turn ON time delays may be changed as a function of a proportional-integral-derivative ("PID") controller, or as a function of preset delay times dependent on temperature error. This may be achieved by, e.g., controlling actuation of a specific number of lamps out of a multitude of lamps as a function of controller output.

In embodiments of a method for belt roll fuser stepped power control, a belt roll fuser assembly may have a first fuser heating member, a second fuser heating member, and a third fuser heating member. The fuser heating member may be a quartz lamp or a heating rod. A total fuser power may be allocated to the belt roll fuser assembly. The method may include applying power to the first fuser heating member in response to a power signal that is substantially equal to or greater than one-third of the total allocated power; applying power to the second fuser heating member in response to a power signal that is substantially equal to or greater than two-thirds of the total allocated power; and applying power to the third fuser heating member in response to a power signal that is substantially equal to the total allocated power.

In embodiments, a stepped power fuser control method for controlling power for a fuser assembly using discrete power levels may include turning on a first fuser heating member in response to a first power level signal output by a controller; and turning on a second fuser heating member in response to a second power level signal. Further embodiments may include turning on a third fuser heating member based on a third power level signal output by the controller.

Embodiments of a system and apparatus may include a controller of the fuser assembly. The controller may be a PID controller or other suitable controller now known or later developed. The controller may receive input such as sensed temperature data from a sensor that detects a temperature of a component of the fuser assembly, or a temperature error based on a sensed temperature data. The controller may output a power signal that corresponds to one or more power levels.

The fuser assembly may include at least two fuser heating members that are each arranged to be discretely controlled. The controller may be configured to communicate a power control signal to the fuser assembly to control each of the two fuser heating members independently. The power control signal output is as a function of at least one of a detected fuser assembly temperature error and a media type.

In alternative embodiments, for control of a fuser assembly having at least a first fuser heating member, a second fuser heating member, and a third fuser heating member, each being connected to a controller that outputs power level signals, methods may include determining a temperature error by comparing a predefined or target fuser component temperature with an actual fuser assembly component temperature; outputting no power level signal when the determined temperature error is less than a first temperature threshold; outputting a first power level signal when the determined temperature error is substantially equal to or greater than a first temperature threshold, and less than a second temperature threshold; outputting a second power level signal when the determined temperature error is substantially equal to or greater than a second temperature threshold, and less than a third temperature threshold; and outputting a third power level signal when the determined temperature error is substantially equal to or greater than a third temperature threshold. Further embodiments may include repeating said temperature data input and power control signal output to minimize temperature fluctuation and/or control fuser average power.

In further embodiments, methods may include turning on no fuser heating member in response to the first power level signal; turning on one of the first, second, and third fuser heating members in response to the second power level signal; turning on two of the first, second, and third fuser heating members in response to the third power level signal; and turning on three of the first, second, and third fuser heating members in response to the fourth power level signal.

Exemplary embodiments are described herein. It is envisioned, however, that any system that incorporates features of methods, apparatus, and systems described herein are encompassed by the scope and spirit of the exemplary embodiments.

DETAILED DESCRIPTION

Figure 1:
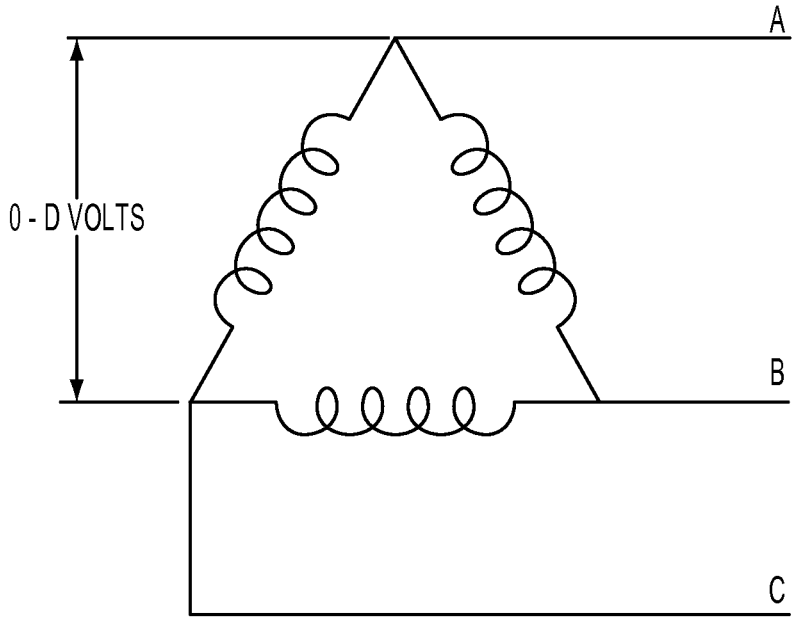
FIG. 1 shows a diagram of an exemplary delta connection arrangement of belt roll fuser lamps in a fuser assembly of a system in accordance with an exemplary embodiment.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for fuser assembly power control to reduce temperature error and satisfy harmonic and flicker requirements. In the drawings, like reference numerals are used throughout to designate similar or identical elements. The drawings depict various embodiments and data related to embodiments of illustrative methods, apparatus, and systems for fuser assembly power control.

A belt roll fuser may include one or more fuser heating members. A fuser heating member may be, for example, a quartz lamp and/or a heating rod. Alternatively, the fuser heating member may be another system or device suitable for fusing an image to a substrate.

A fuser assembly, such as a belt roll fuser assembly, may include three fuser heating members, e.g., lamps. Each of the fuser heating members may be discretely controlled. For example, in a fuser assembly having three lamps, each of the lamps may be turned on or off independent of each other. The lamps may be arranged in a three-phase delta connection as shown in FIG. 1.

Figure 2:
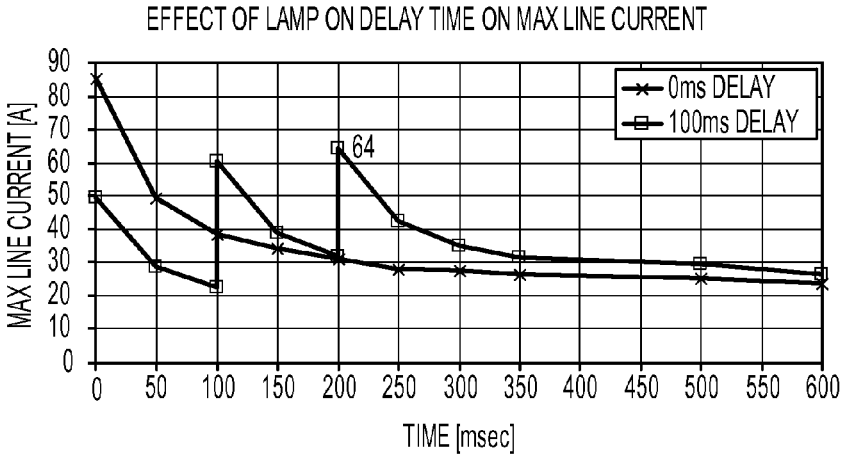
FIG. 2 is a graph showing line current as a function of time when lamps turn ON with a 100 ms delay.

The lamps may be connected in a three-phase delta connection with, for example, a line voltage of 187 VAC at 60 Hz. In such an arrangement, where the three fuser heating members are turned on at the same time from a cold start, the line in-rush current in line A, B, or C of FIG. 1 may be about 85 amps. If the lamps turn on with a delay, however, the line in-rush current may be significantly reduced. For example, with a delay of at least 100 msec, the line in-rush current may be about 64 amps, which is about a 25% reduction over the line in-rush current attained when turning on all three fuser heating members at substantially the same time from a cold start. The advantages of a turn on delay are evidenced by the exemplary simulation results shown in FIG. 2. Specifically, FIG. 2 shows the effects of a 100 msec turn on delay versus 0 msec turn on delay, i.e., the delay may accommodate a reduction in maximum line current.

Figure 3:
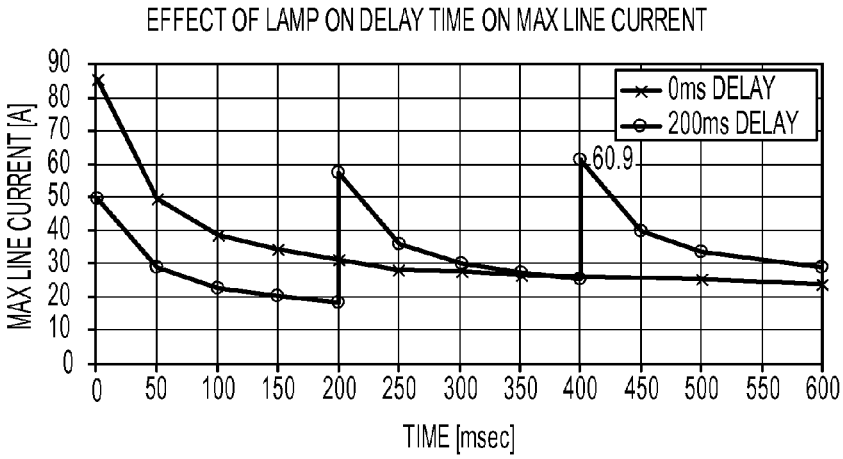
FIG. 3 is a graph showing line current as function of time when lamps turn ON with a 200 ms delay.

Further, it may be observed that if the fuser heating member or lamp turn on delay is increased beyond 100 msec to 200 msec, a greater reduction in maximum line current may be achieved. For example, FIG. 3 shows line current as a function of time. The results were yielded from a simulation wherein lamps were turned on with a 200 msec delay. As shown in FIG. 3, the maximum line current with a 200 msec delay may be about 61 amps.

Figure 4:
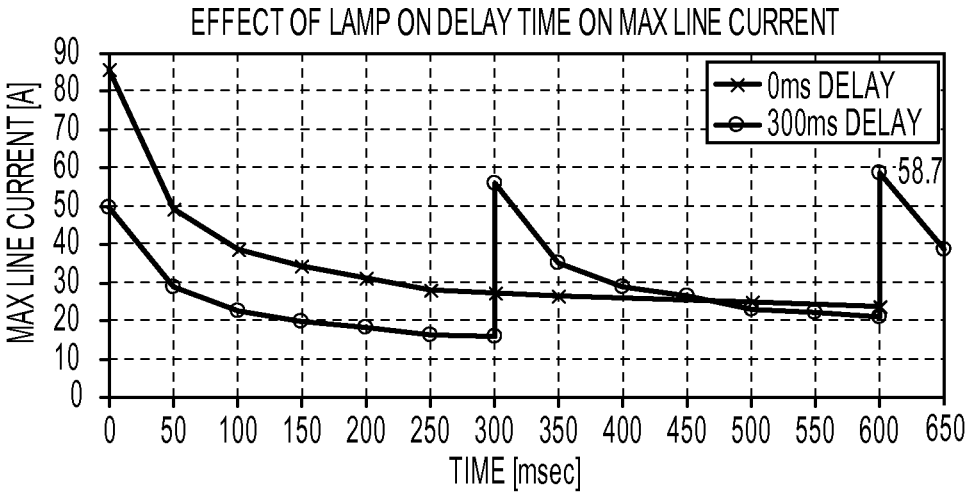
FIG. 4 is a graph showing line current as function of time when lamps turn ON with a 300 ms delay.

Similarly, FIG. 4 shows that a fuser heating member turn on delay of 300 msec may further reduce maximum line current. Specifically, FIG. 4 shows line current as a function of time wherein lamps were turned on with a 300 msec delay. The maximum line current with a 300 msec delay may be about 59 amps. Generally, max line current reduction may be a function of fuser heating member turn on delay, as shown in Table 1 below.

TABLE 1

Max line current reduction as a function of lamp turn ON delay

| Lamp turn ON delay [msec] | Max line current [Amps] | Reduction of max line current [%] |
|---|---|---|
| 0 | 85 | 0 |
| 100 | 64 | 25 |
| 200 | 60.9 | 28 |
| 300 | 58.7 | 31 |
| 600 | 57.9 | 32 |

Table 1 shows that electrical stress can be further reduced further when lamp turn on delay is increased, even beyond 200 msec. For example, an in-rush current of about 58 amps may be achieved by applying turn on delay of 600 msec.

Discrete fuser heating member control may be achieved by controlling fuser turn on delay as a function of a controller output. The delay may be accommodated by controlling the power applied to the fuser heating members of the fuser assembly. Specifically, the fuser assembly may be connected to a controller. The controller may be configured to control when a fuser heating member of the fuser assembly turns on and/or off. For example, in an assembly with three fuser heating members, e.g., lamps or heated rolls, the controller may delay a turn on of one or more lamps based on preset delays, or as a function of temperature error, and/or media type, by outputting a power signal. The power signal may correspond to a discrete power level, which may be a predefined value or range of values assigned to one or more fuser heating members.

In embodiments, fuser heating members of the fuser assembly may be controlled as a function of an output of the controller. Any suitable controller, such as a PID controller, may be implemented. The controller may also be connected to a temperature sensor, and may be configured to determine or receive a temperature error. For example, the temperature sensor may be configured to sense a temperature of a fuser assembly component. The monitored fuser assembly component may be, for example, a fuser belt. The sensed temperature, or actual temperature, may be compared with preset or target temperature value, or range of values, to yield a temperature error value or range of values. The controller may output a power level signal for control of one or more fuser heating members based on the temperature error. This process may be repeated continuously to, e.g., reduce temperature error or maintain reduced temperature error.

Figure 5:
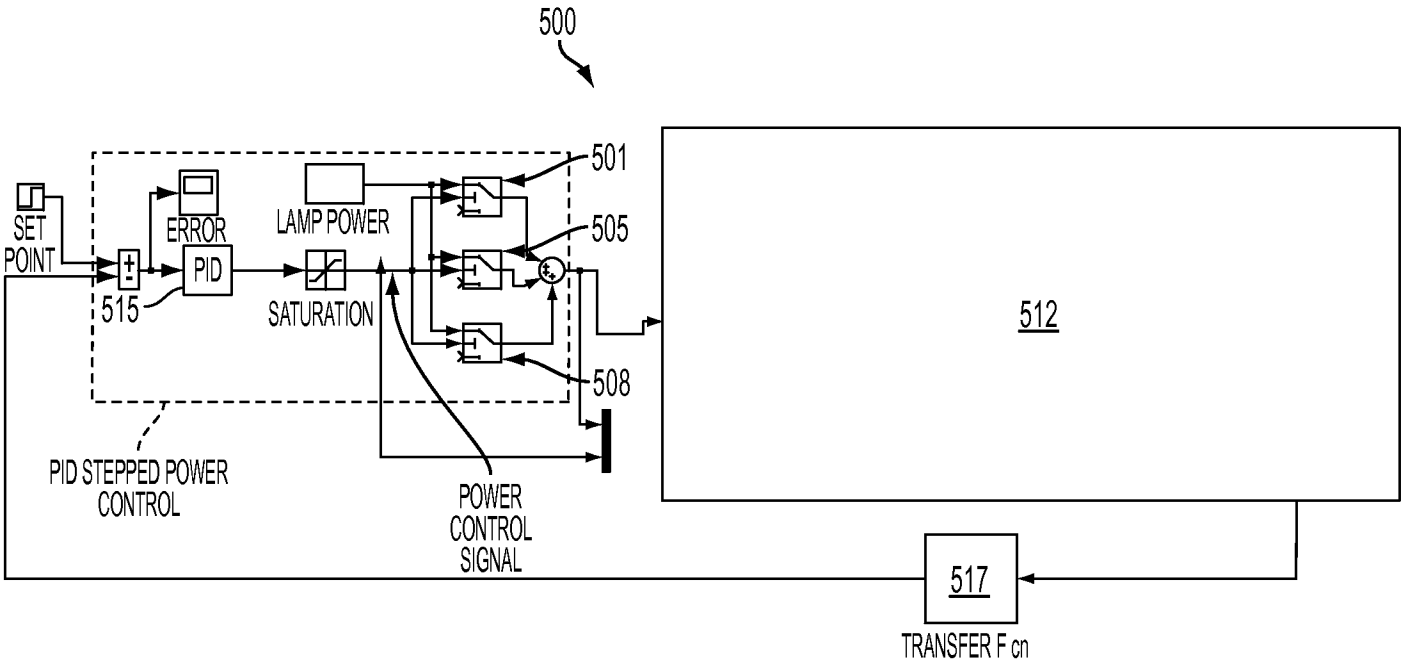
FIG. 5 shows a diagram of a fuser assembly connected to a controller configured in accordance with an exemplary embodiment.

In an embodiment, a belt roll fuser may have three fuser heating members, as shown in FIG. 5. In belt roll fuser stepped power control system 500, lamps 501, 505, and 508 may be connected to a controller 515. The controller 515 may be a PID controller, or any other suitable controller. The controller 515 may be configured to communicate a power signal to one or more of lamps 501, 505, and 508. The controller 515 may be configured to receive, e.g., an error input that is based on a parameter such as a temperature of a fuser assembly component of fuser system 512. The error input may be used to determine whether the controller 515 transmits a control signal, or what type of control signal the controller 515 transmits to lamps 501, 505, and 508.

A type of control signal transmitted by controller 515 may be a discrete power level that corresponds to a range of power, or an amount of power output by the controller 515 as a control signal for lamps 501, 505, and 508. For example, each of lamps 501, 505, and 508 may be allocated one third of the total fuser power. If only one third of the total fuser power is required by the fuser assembly, the control system 500 may actuate any one of the three lamps 501, 505, and 508 without compromising thermal controls or any other functions. Similarly, the fuser assembly may operate with two thirds of the total allocated fuser power using any two of the lamps 501, 505, and 508. If total fuser power is required, then all three of the lamps 501, 505, and 508 may be turned on by applying 100% of the total allocated fuser assembly power.

Thus, the used fuser power may be controlled in, for example, four discrete levels: 0%, 33.3%, 66.6%, and 100%. Further, the fuser average power may be controlled in a continuous manner. For example, the belt roll fuser control system 500 shown in FIG. 5 may be configured to continuously feed temperature error inputs to controller 515. The error inputs may be received from, or may be based on data received from a temperature sensor 517. Temperature sensor 517 may be configured to produce and transmit raw data or manipulated data. Temperature sensor 517 may be configured to monitor, receive, manipulate and/or gather data related to monitoring of components of fuser system 512. Controller 515 may be configured to output power control signals that relate to the received error inputs. Lamps 501, 505, 508 may be configured to each discretely turn on depending on the output power control signal. For example, at a first power level of 0%, if the control output is less than about 33.3%, then the total used fuser power may be zero, and zero lamps may be turned on. If the control output is about 33.3% and less than 66%, then at a second power level, 33% of the fuser power may be used, and one of lamps 501, 505, and 508 may be turned on. At a third power level, where 66.6% of power used in response to a control output of about 66.6% and less than 100%, two of lamps 501, 505, and 508 may be turned on. At a fourth power level, where about 100% of the total allocated fuser power is used in response to a control output of about 100% or greater, all three of lamps 501, 505, and 508 may be actuated. The system may be expanded to include more lamps, and modified appropriately, without departing from the spirit and scope of the disclosed embodiments.

Figure 6:
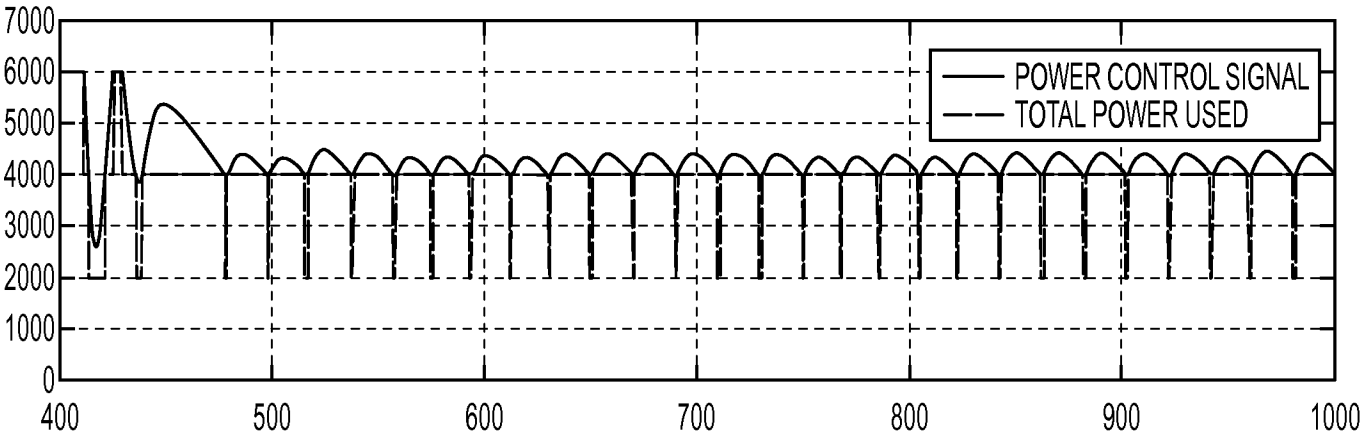
FIG. 6 is a graph showing power control performance in accordance with an exemplary embodiment.

A method and system in accordance with the embodiment shown in FIG. 5 was tested. The results, shown in FIG. 6, illustrate that controller 515, being connected to lamps 501, 505, and 508, may be configured to dynamically control both a delay and duty cycle of each lamp in order to follow a trend of power. The fuser power may effectively be controlled as a function of the power output requested by the controller.

Figure 7:
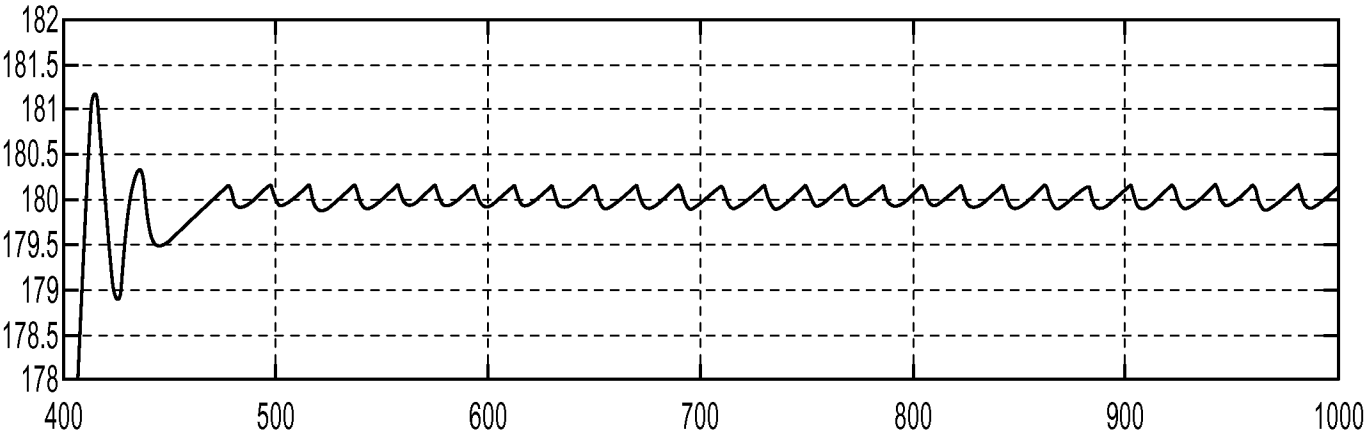
FIG. 7 is a graph showing fuser belt temperature variation when using temperature control in accordance with an exemplary embodiment.

The controller and system may be configured so that a temperature error converges to about a steady state, with acceptable temperature variation. For example, FIG. 7 shows that very tight temperature control may be achieved by, e.g., the belt roll fuser stepped power control of, e.g., FIG. 5. Specifically, FIG. 7 shows fuser belt temperature variation when using a system in accordance with embodiments disclosed herein.

Figure 8:
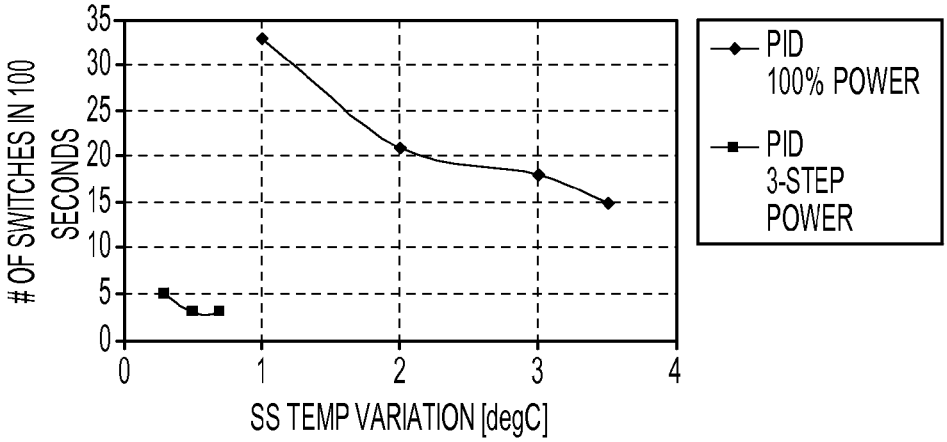
FIG. 8 is a graph showing a number of lamp switches as a function of achieved temperature variation.

In embodiments, a system with a controller and stepped power control may achieve low temperature fluctuation with a reduced number of lamp switches. FIG. 8 shows a comparison of results of testing for a system implementing a PID controller with 100% power versus stepped power. FIG. 8 shows that the stepped power approach may reduce temperature variation below one degree Celsius using less than five switches. The 100% power approach requires over 30 lamp switches in 100 seconds to barely achieve a one degree Celsius temperature variation.

Figure 9:
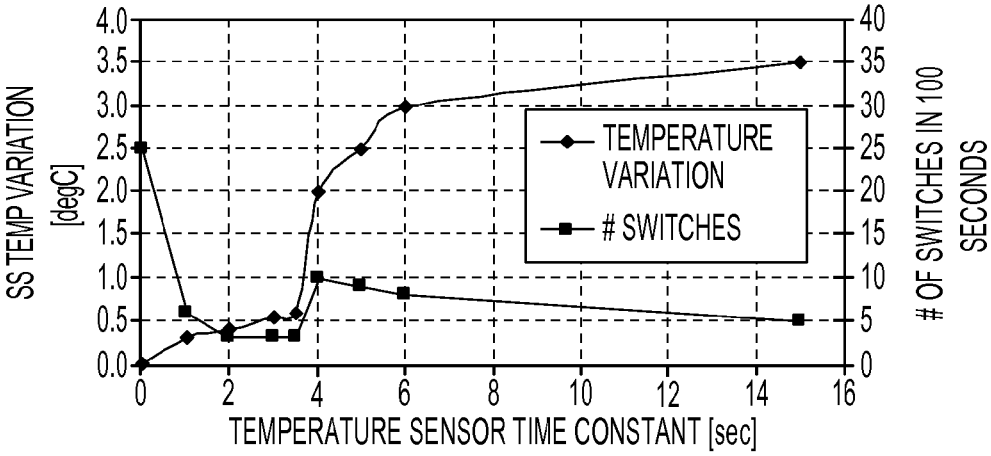
FIG. 9 is a graph showing lamp switches and steady state temperature variation as a function of temperature sensor time constant.

Further, the PID stepped power control approach is fairly insensitive to temperature sensor time constants of up to 3.5 seconds, as shown by the simulation results depicted by the graph of FIG. 9. For example, there may be two temperature sensor choices for the belt roll fuser, one having a time constant of 3.5 seconds, and the other one having a time constant of 15 seconds. The faster, 3.5 second sensor may yield temperature variations of about one degree Celsius or less. The slower sensor may yield a temperature variation of about 3.5 degrees Celsius.

Figure 10:
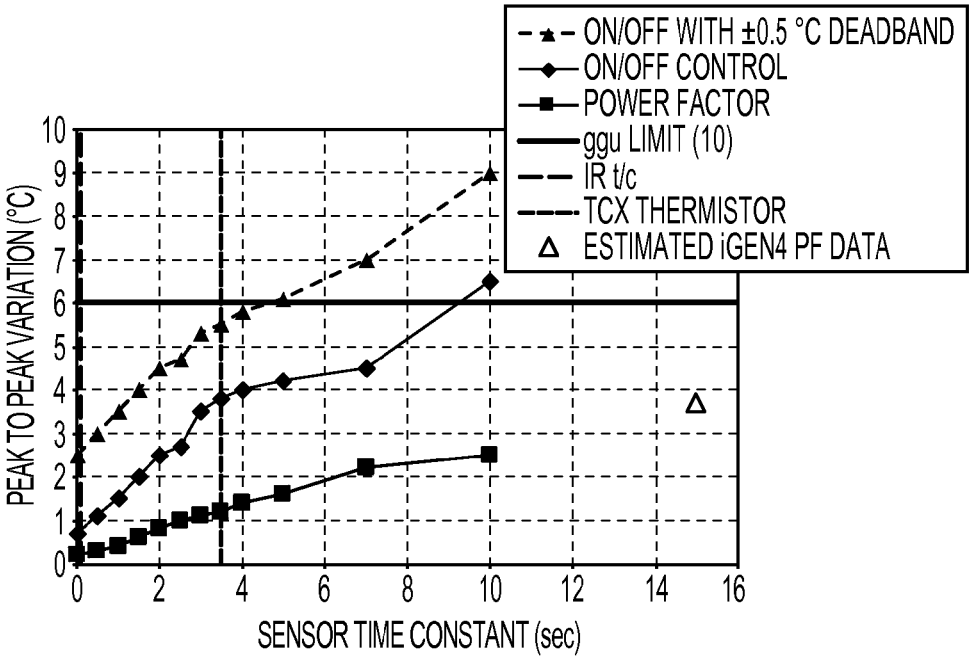
FIG. 10 is a graph showing temperature variation as a function of temperature sensor time constant for Power Factor control, ON/OFF control, and ON/OFF with dead band.

As shown in FIG. 10, a system having a controller such as a PID controller that is configured in accordance with exemplary embodiments may achieve better performance than when using a power factor control. Aside from the advantage of a tight temperature control, the PID stepped power control will not require the additional hardware that permits to reduce the total power that is achieved by using cycle stealing or other power control methods.

In embodiments, power control may be accommodated using three discrete power levels by actuating one, two, or three lamps depending on the power level communicated by a connected controller's output power signal. Because the three lamps can be used independently of one another, the lamps may be controlled using, for example, 33.3% power, 66.6% power, and 100% power. At a fourth power level, 0%, no lamp may be actuated. The power control may follow such power levels as a function of, e.g., temperature error. Temperature error may be a difference between a setpoint temperature of a fuser assembly component and an actual temperature of the component, which may be obtained using a sensor.

Figure 11:
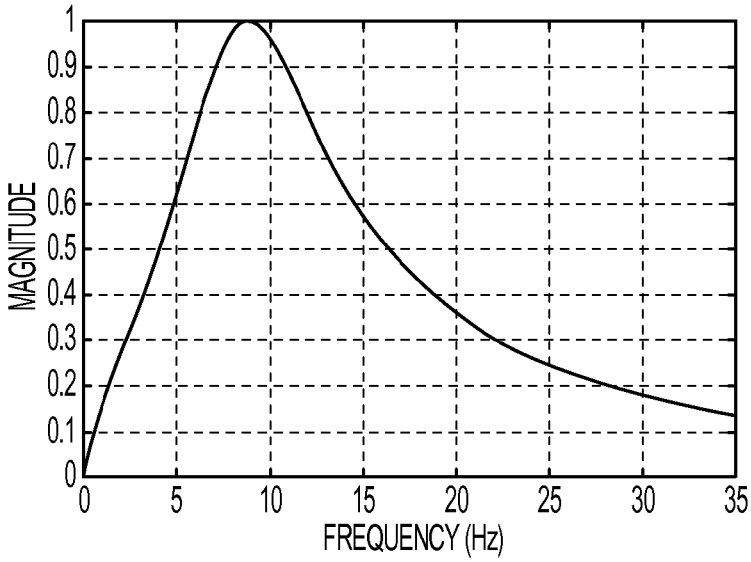
FIG. 11 is a graph showing flicker sensitivity.

PID stepped power control with lamp turn on delay may permit a more favorable mode for flicker control. Flicker requires the amount of in-rush current to be limited. In-rush current may cause the line voltage to drop, and require the system to operate ideally outside frequency ranges of, e.g., 1 Hz to 35 Hz, as shown in FIG. 11. Power control in accordance with an exemplary embodiment may include five switches per 100 seconds, which may yield frequencies lower than 1 Hz and limit in-rush current without requiring costly power control hardware.

While methods, apparatus, and systems for fuser assembly power control is described in relationship to exemplary embodiments, many alternatives, modifications, and variations would be apparent to those skilled in the art. Accordingly, embodiments of the methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for belt roll fuser assembly stepped power control, the belt roll fuser assembly having a first fuser heating member, a second fuser heating member, and a third fuser heating member, a total fuser power being allocated to the belt roll fuser assembly, the method comprising:

applying power to the first fuser heating member in response to a power signal that is equal to or greater than one-third of the total allocated power;

applying power to the second member in response to a power signal that is equal to or greater than two-thirds of the total allocated power; and applying power to the third member in response to a power signal that is substantially equal to the total allocated power.

2. The method of claim 1, further comprising:

outputting the power signal using a PID controller, the PID controller being connected to the fuser assembly.

3. The method of claim 1, the applying power to the second member being after a predetermined time delay.

4. The method of claim 3, wherein the predetermined time delay is a first predetermined time delay, the applying power to the third member being after a second predetermined time delay.

5. The method of claim 4, wherein the second predetermined time delay is controlled by a PID controller.

6. The method of claim 4, wherein at least one of the first predetermined time delay and the second predetermined time delay is a function of at least one of a temperature error and a media type.

7. The method of claim 4, wherein at least one of the first predetermined time delay and the second predetermined time delay is about 200 ms.

8. The method of claim 4, wherein at least one of the first predetermined time delay and the second predetermined time delay is about 300 ms.

9. The method of claim 4, wherein at least one of the first predetermined time delay and the second predetermined time delay is about 600 ms.

10. The method of claim 3, wherein the predetermined time delay is a preset delay.

11. The method of claim 1, the applying power to the first fuser heating member being in response to a power signal that is less than two-thirds of the total power.

12. The method of claim 1, the applying power to the second fuser heating member being in response to a power signal that is less than the total allocated power.

13. A stepped power fuser control method for controlling power for a fuser assembly using discrete power levels, the method comprising:

turning on a first fuser heating member in response to a first power level signal output by a controller; and turning on a second fuser heating member in response to a second power level signal;

turning on a third fuser heating member based on a third power level signal output by the controller;

turning off the third fuser heating member in response to a second or first power level signal;

turning off the second fuser heating member in response to a first power level signal; and turning off the first fuser heating member, the second fuser heating member, and the third fuser heating member when no power level signal is output.

14. The stepped power fuser control method of claim 13, the method further comprising:

determining an actual temperature of a fuser assembly component;

determining a temperature error by comparing the determined actual temperature with a target temperature; and outputting at least one of a first power level signal, a second power level signal, and a third power level signal based on the determined temperature error.

15. The stepped power fuser control method of claim 13, wherein the first power level, the second power level, and the third power level are each a function of at least one of a temperature error and a media type.

16. A method for fuser assembly temperature control, the fuser assembly having at least a first fuser heating member, a second fuser heating member, and a third fuser heating member, each being connected to a controller that outputs power level signals, the method comprising:

determining a temperature error by comparing a target fuser component temperature with an actual fuser assembly component temperature;

outputting a first power level signal when the determined temperature error is substantially equal to or greater than a first temperature threshold, and less than a second temperature threshold;

outputting a second power level signal when the determined temperature error is substantially equal to or greater than a second temperature threshold, and less than a third temperature threshold; and outputting a third power level signal when the determined temperature error is substantially equal to or greater than a third temperature threshold.

17. The method of claim 16, further comprising: turning on one of the first, second, and third fuser heating members in response to the first power level signal; turning on two of the first, second, and third fuser heating members in response to the second power level signal; and turning on three of the first, second, and third fuser heating members in response to the third power level signal.

* * * * *